US011920346B2

(12) United States Patent
Kohlschein

(10) Patent No.: US 11,920,346 B2
(45) Date of Patent: Mar. 5, 2024

(54) MODULE AND METHOD FOR PRODUCING A MODULE, A BUILDING WALL AND A BUILDING

(71) Applicant: Franz-Axel Kohlschein, Warburg (DE)

(72) Inventor: Franz-Axel Kohlschein, Warburg (DE)

( * ) Notice: Subject to any disclaimer, the term of this patent is extended or adjusted under 35 U.S.C. 154(b) by 0 days.

(21) Appl. No.: 16/971,918

(22) PCT Filed: Feb. 25, 2019

(86) PCT No.: PCT/DE2019/000047

§ 371 (c)(1),
(2) Date: Aug. 21, 2020

(87) PCT Pub. No.: WO2019/166039

PCT Pub. Date: Sep. 6, 2019

(65) Prior Publication Data

US 2021/0095470 A1 Apr. 1, 2021

(30) Foreign Application Priority Data

Feb. 27, 2018 (DE) ..... 10 2018 001 516
Mar. 5, 2018 (DE) ..... 10 2018 001 689

(51) Int. Cl.

| | |
|---|---|
| ***E04C 2/28*** | (2006.01) |
| ***E04C 2/288*** | (2006.01) |
| ***E04C 2/52*** | (2006.01) |
| *E04B 1/16* | (2006.01) |
| *E04B 2/02* | (2006.01) |
| *E04B 2/86* | (2006.01) |
| *E04C 2/00* | (2006.01) |

(52) U.S. Cl.
CPC ..... *E04C 2/288* (2013.01); *E04C 2/521* (2013.01); *E04B 1/165* (2013.01); *E04B 2002/0293* (2013.01); *E04B 2/8629* (2013.01); *E04C 2002/004* (2013.01)

(58) Field of Classification Search
CPC .... E04C 2/288; E04C 2/521; E04C 2002/004; E04C 2/00; E04C 2/48; E04B 1/165; E04B 2/8629; E04B 2002/0293; E04B 2/54; E04B 1/7675; E04B 1/12; E04B 1/02
See application file for complete search history.

(56) References Cited

U.S. PATENT DOCUMENTS 3,766,699 A * 10/1973 Dinkel ..... B62D 29/045 52/591.4
3,898,779 A 8/1975 Tracy
(Continued)

FOREIGN PATENT DOCUMENTS

DE 102006028532 B3 10/2007
FR 2239571 A1 2/1975
(Continued)

*Primary Examiner* — Patrick J Maestri
(74) *Attorney, Agent, or Firm* — Laurence A. Greenberg; Werner H. Stemer; Ralph E. Locher

(57) ABSTRACT

A module, in particular for a building, includes a wall having at least two, preferably parallel, wall outer sides, which are spaced apart from one another. At least one channel is disposed between the two wall outer sides and is filled with a self-curing material. A building including at least one module, a method for producing a module, a method for producing a building wall and a method for producing a building, are also provided.

22 Claims, 7 Drawing Sheets

(56) References Cited

U.S. PATENT DOCUMENTS

| | | | | | |
|---|---|---|---|---|---|
| 4,098,042 | A * | 7/1978 | Sachs | E04B 2/68 | 52/576 |
| 4,523,415 | A * | 6/1985 | Rosen | E04C 2/043 | 52/220.2 |
| 5,729,942 | A * | 3/1998 | Moore, Jr. | E04C 1/40 | 52/211 |
| 2013/0312349 | A1 * | 11/2013 | Hileman | E04B 2/8629 | 52/421 |

FOREIGN PATENT DOCUMENTS

| | | | | |
|---|---|---|---|---|
| FR | 2866040 | A1 | 8/2005 | |
| WO | WO-2012158031 | A1 * | 11/2012 | E04B 1/165 |

* cited by examiner

MODULE AND METHOD FOR PRODUCING A MODULE, A BUILDING WALL AND A BUILDING

BACKGROUND OF THE INVENTION

Field of the Invention

The invention relates to a module for constructing a building wall of a building, and to a method for producing such a module and also a building wall and a building.

Buildings are known which are constructed from masonry walls. Here, the masonry walls of the building perform various tasks, such as protection and delimitation of the building interior, thermal insulation and load dissipation. Masonry walls are a major element of the building statics.

Masonry walls can basically be distinguished, in terms of their construction, between masonry walls composed of mineral material such as stone or concrete and masonry walls composed of organic material such as construction wood. Wall systems of mineral construction have the advantage of more favorable structural physical characteristics, and they are inexpensive to obtain and widely locally available. The disadvantage thereof is the high weight for transportation and the lack of prefabrication capability, which leads to increased working costs in the creation of walls.

Mineral masonry walls must be produced from individual separate bricks or from concrete shells. This requires a large number of qualified personnel, who must build such a masonry wall over long periods of time. Furthermore, enormous logistical effort is required to provide sufficient mortar and bricks for the masonry walls of the building. If one of these essential components is lacking, then the masonry wall cannot be finished, such that the entire building operation on a building site comes to a standstill. Not least, the weight of these components for a masonry wall is very high, for which reason only small quantities of the components can be transported. Conventional walls are therefore uneconomical with regard to construction and planning.

Furthermore, the interior construction of buildings from masonry walls is very cumbersome and time-consuming, because all installations must be fitted on site in the building with finished masonry walls. Thus, the necessary material must be transported to the building site, and further qualified personnel must be appointed.

Likewise, the insulation and the fitting of the building with windows and doors must be performed in an uneconomical manner on site, wherein a responsible site manager is again faced with great logistical challenges.

DE 10 2006 028 532 B3 has proposed a complex and multi-part formwork for a concrete structure, which requires large quantities of concrete. Furthermore, a multiplicity of installation steps is required in order to create the formwork, again locally on the building site. It is furthermore particularly disadvantageous that the interior construction and a fitting of insulation, windows and doors must be performed on site.

The complex circumstances involved in the erection of a building have hitherto not been resolved in the prior art. It is therefore an object of the invention to provide a device and a method which makes it possible to build a building quickly and inexpensively and nevertheless utilize mineral building materials and the favorable characteristics thereof.

SUMMARY OF THE INVENTION

The object is achieved according to the invention by means of the features of the independent claims.

The present invention has the advantage over the prior art that a module is prefabricated and manufactured centrally at a factory. Here, manufacturing is to be understood inter alia to mean the production of modules with uniform dimensions. In this way, a modular system of finished modules is realized which are provided locally on a building site. Owing to the modular system, it is possible to use personnel with a uniform qualification. Alternatively, it is possible to use personnel with different qualifications for the same work in the erection of the modules, because only simple technical knowledge is required for the work. Owing to the modular system composed of modules, the site manager can easily control the planning and execution of the building activity remotely without being on site. Less planning effort is thus required. Owing to the simple and calculable structure of the modules, predeterminable static characteristics of the wall structure are obtained. This reduces the in particular on-site planning effort for a site manager.

By means of the modular system, a building with at least one module is created, wherein the building walls preferably comprise at least one module.

To attain the advantages, at least two wall outer sides of a wall are arranged spaced apart from one another. It is proposed that at least one channel be arranged between the two wall outer sides for example of two outer walls. This configuration of the module is performed at the factory. Such a module has a low weight, because no heavy and bulky components are used.

The wall outer sides are preferably parallel planes. It is also conceivable to use a tubular wall in which a channel is formed, such that a module for a column is provided, wherein said wall may for example be of cylindrical and/or conical and/or cuboidal and/or pyramid shape. Furthermore, modules for corners of a house are conceivable. Curved or angled walls are also possible, wherein the curve/the angle is possible in the vertical and in the horizontal direction with respect to the building to be erected.

On site, after the module has been positioned in accordance with the requirements of the user, the channel can be filled with a self-curing material. The filling is performed while the self-curing material is in liquid form. It cures within the channel. The channel acts as a lost formwork.

By means of the manufacturing of the modules at a factory in accordance with the invention, different standardized modules are manufactured centrally. The standardized modules may be manufactured in a series, such that they can be categorized on the basis of a catalogue. Alternatively, non-series special manufacture in accordance with a building plan is also easily possible. Here, the modules have a standardized dimension, which relates for example to the desired room height of the building. Furthermore, a site manager does not need to dispense with individual configurations of the building, because the modules from series manufacture or the specially manufactured modules may be combined with classic masonry wall work. It is also possible for the modules to be adapted and cut to size on site by the responsible site manager. A module may be created using submodules, by means of the combination of which an individualized module can be created by the site manager. Owing to the central manufacturing process, it is possible to use a multiplicity of different materials. It is thus possible to use recycled material and/or mineral material and/or organic material.

The dependent claims relate to advantageous refinements and alternative embodiments of the module.

Here, the self-curing material comprises preferably concrete and/or plastics-containing material, such as a plastics resin, and/or a gypsum-containing material. The filler material may be of mineral form. Easy processing is thus realized, which can be performed by personnel with little technical knowledge. Through the use of in particular concrete and/or plastics-containing material, high durability and static reliability are attained.

One advantageous refinement comprises a channel, which is a conduit. A conduit can for example be adhesively bonded between two outer walls. The conduit is alternatively fixable between the wall outer sides by fastening means such as screws and/or rivets and/or wire and/or a fabric and/or a clip system. The channel can be particularly easily and reliably filled with the self-curing material if the channel is a circular conduit. A conduit with a polygonal profile may likewise be used in order to thus fill the space between the wall outer sides to a greater degree. The conduit is preferably constructed from hollow firebricks and/or concrete conduits and/or plastics conduits and/or metal conduits.

The channel expediently has an opening to the outside, such that the channel can be easily filled with the liquid self-curing material from outside the wall. Said opening is arranged in particular between the wall outer sides in the region of the edge of the wall. It is alternatively or additionally possible to form an opening in a wall. Here, the opening may be merely a hole in the wall, which leads to the channel, or may have a screwable connector to which, for example, a hose of a concrete pump can be attached.

In order that the stiffness of the module is ensured, it is advantageous if a reinforcement is arranged at least partially in the channel. The reinforcement extends preferably along the channel. Here, the reinforcement is composed in particular of reinforcement rods composed of steel, which are pushed into the channel before the self-curing material is filled in. Structural alternatives are meshes, fabrics, lattices or baskets, wherein, as material, use may be made not only of steel but also of other metals, glass fibers, plastics fibers, carbon fibers, ceramics or further plastics. The reinforcement may also be pushed in while the self-curing material in a channel is in liquid form. It is not necessary for the entire channel, with respect to its length, to be equipped with a reinforcement. In addition to a steel rod, it is possible for a ring composed of steel to be inserted into the channel. A braided fabric composed of metal wire or plastics fabric is also possible as reinforcement. It is also possible to omit the reinforcement if the channel offers a high level of stiffness. For example, for this purpose, the channel may be manufactured from a steel conduit or from a steel-concrete conduit, in the wall of which a reinforcement is already contained. This simplifies the process steps on site, such that the personnel do not need to be trained in the use of reinforcement technologies.

A particularly wide variety of possible uses for a module is attained if multiple channels are arranged in the module. It is preferable for at least two channels to be arranged between the wall outer sides or in a column-like wall. The channels are in particular oriented perpendicularly and/or parallel with respect to one another. If the channels transition into one another, it is possible for all interconnected channels to be filled through one opening. For example, channels may intersect at a right angle and form a cross-shaped channel. It is however alternatively possible for the channels to be formed separately from one another, such that they must be filled via different openings.

According to the invention, the channels formed within the modules from the lost formwork give rise to a post or post-and-beam structure. The post or post-and-beam structure may in this case be formed throughout the modules and/or the walls of a building. The post-and-beam structure may advantageously at least partially form a framework. After the filling with self-curing material such as concrete, an inherently stable and solid skeleton is thus created which can perform static wall functions.

In one refinement of the invention, the skeleton structure conforming to a post-and-beam structure which is produced in the wall modules as a result of filling of the channels can be structurally connected to ceiling or foundation portions situated thereabove and therebelow.

In one refinement of the invention, a honeycomb or mesh structure may be arranged in the compartments formed by the post or post-and-beam structure. Said structure may be composed of wood and/or wood derivatives and/or pressboard and/or fibrous material and/or plastics and/or limestone and/or sand-lime brick and/or clay/firestone and/or loam and/or synthetic resin and/or concrete and/or porous or straw concrete and/or mineral foam and/or a curing foam such as polystyrene or polyurethane and/or a gypsum-like material. The honeycomb or mesh structure may also perform static functions in the wall module. The honeycomb or mesh structure may be fastened to the channels and/or to the inner sides of the outer walls of the module.

The ceiling or the foundation may each have at least one tongue below and/or above the wall modules to be mounted. The tongue may engage into a receptacle which is in the form of a groove and which is formed on the bottom side and/or top side of the wall module. This likewise applies to door or other passage modules in the case of which the additional floor fixture, for example floor screed, floor heating arrangement, insulation or other known floor fixtures, result in a level of the door sill flush with the floor. Here, the groove and tongue are connected to form a positively locking connection. It is also possible for a cohesive connection to be produced by means of adhesive or mortar between the groove and tongue. A further embodiment comprises a tongue of the foundation or ceiling structure which is formed entirely or partially as a lost formwork and to which the lost formwork in the walls is connected. This constitutes a formwork channel. Consequently, a connection between the skeleton structure and the groove and/or tongue forms as a result of a filling process. An alternative embodiment in relation to that described above comprises a tongue which is guided into the lost formwork of the wall modules for example by means of reinforcement steel or fabric. In this case, the filling is performed with self-curing material such as has already been described for the channels in the wall modules.

The channel is preferably open upwardly toward the ceiling. Vertically arranged channels in the wall modules, which channels act as posts, end in this vertical channel in the region of the ceiling. The lost formworks at the upper end of the wall modules may be connected to one another to form a horizontal formwork level in the module. This horizontal formwork level may, if required, be closed at the open longitudinal ends. As a result of the filling of this horizontal formwork level with self-curing material and the installation of reinforcements or rods, it is possible for a supporting beam to be formed by means of the wall modules. The supporting beam may also, if required, be formed into a ring beam across multiple modules. It is also described in the invention that, from the formwork channel formed by the upper wall module regions, reinforcements are guided into the storey slab to be placed on thereabove. Through the use of liquid self-curing material for filling into the formwork channel and the storey slab, a non-positively locking and cohesive connection is thus possible.

One advantageous refinement of the invention comprises a filler material which surrounds the channel. The filler material is filled in between the outer walls, or in the case of a column-like module, within the closed wall, such that the channels are arranged at least partially within the filler material. Here, the filler material comprises polyurethane foam and/or lightweight concrete and/or straw concrete and/or mineral foam and/or expanded stone and/or porous concrete and/or limestone and/or sand-lime brick and/or clay/firestone and/or wood and/or wood derivatives and/or wood fibers and/or other organic fibrous material and/or other inorganic or mineral fibrous material and/or loam and/or cob and/or sand and/or bulk material and/or polystyrene and/or glass wool and/or rock wool and/or recycled material and/or paper and/or asbestos. Instead of fastening means for the fixing of the conduits, it is also possible to use a foam, composed for example of polyurethane or polystyrene or mortar or adhesive, for the fixing. Furthermore, a channel may be manufactured by virtue of a foam being filled between the outer walls, and channels subsequently being formed in the foam for example by cutting and/or by heat and/or by pressing.

It is advantageous if an insulation layer is attached to a first wall outer side of a wall. Here, the first wall outer side is the outer side of the building manufactured from the modules, such that the insulation protects against heat and cold. The insulation layer comprises polyurethane foam and/or lightweight concrete and/or straw concrete and/or mineral foam and/or expanded stone and/or porous concrete and/or limestone and/or sand-lime brick and/or clay/firestone and/or wood and/or wood derivatives and/or wood fibers and/or other organic fibrous material and/or other inorganic fibrous material and/or cob and/or sand and/or bulk material and/or polystyrene and/or glass wool and/or rock wool and/or recycled material and/or paper and/or asbestos and/or mineral wool and/or wool and/or mineral material and/or a foam, composed for example of polyurethane, and/or at least one vacuum chamber. The insulation layer is preferably fastened to the module centrally at the factory. It is however also possible for the insulation to be attached locally on the building site.

On a second wall outer side, there is formed an installation level for electrical and/or hydraulic and/or pneumatic and/or data and/or heating and/or ventilation lines. The second wall outer side is directed into the interior of the building. Wall modules from which internal walls are formed have an installation level on both wall outer sides. Installation elements such as plug sockets and/or switches and/or loudspeakers and/or water faucets and/or drains are attached to the installation level. Drainpipes of relatively large diameter, such as downpipes, may either project into the intermediate space between the walls or may be supplemented by special wall elements. The special wall elements include the drainpipes and either are fixedly installed on a module or can be added separately to a module locally on the building site. The installation level is at least partially directed into a room of the building. Here, the installation level is formed preferably by a homogeneous layer. The homogeneous layer comprises preferably wood and/or a foam and/or multipurpose panels and/or pressboard panels and/or aerated concrete blocks and/or bricks and/or polystyrene and/or hard foam panels and/or polyurethane foam and/or lightweight concrete and/or straw concrete and/or mineral foam and/or expanded stone and/or porous concrete and/or limestone and/or sand-lime brick and/or clay/firestone and/or wood and/or wood derivatives and/or wood fibers and/or other organic fibrous material and/or other inorganic fibrous material and/or cob and/or loam and/or sand and/or bulk material and/or polystyrene and/or glass wool and/or rock wool and/or recycled material and/or paper and/or asbestos.

Bores which serve for receiving lines, for example, may be formed into in particular a homogeneous layer of the installation level. Factory-produced pilot bores, or a formed-in perforation in the form of cavities, recesses or the like, make it easier for bores adapted to the diameter of the lines to be formed in at a building site.

Alternatively, a lining wall is arranged in front of the second wall outer side. The lines are arranged between the lining wall and the wall outer side. The lining wall is attached to a lattice structure or to the described installation level. The lines are arranged in the cavity between wall and lining wall for example by means of clips and/or empty conduits. Furthermore, it is possible for wooden slats or multipurpose panels to be attached to the second wall outer side in order to produce an installation level. A plaster, which is in organic form, such as loam, and/or in mineral form, such as limestone or cement, is applied to the lining wall. At least one leadthrough to the lines is drilled through the plaster into the installation level. The leadthrough has a fitting opening which is directed toward the interior space and at which the installation elements are mounted. This mounting may be performed centrally at the factory and/or locally on the building site. This facilitates the internal construction of the building.

The wall and/or the lining wall comprise wood, wooden slats, gypsum board, concrete, sheet metal, plastics and/or cardboard and/or polyurethane foam and/or lightweight concrete and/or straw concrete and/or mineral foam and/or expanded stone and/or porous concrete and/or limestone and/or sand-lime brick and/or clay/firestone and/or wood and/or wood derivatives and/or wood fibers and/or other organic fibrous material and/or other inorganic fibrous material and/or cob and/or loam and/or sand and/or bulk material and/or polystyrene and/or glass wool and/or rock wool and/or recycled material and/or paper and/or asbestos. A very flexible configuration of the wall is thus attained. The outer shell of the building is preferably created locally on the building site.

In one advantageous refinement, the module has a window and/or a door and/or passage openings and/or other wall openings, for example for air-conditioning systems or exhaust air shafts. The window and/or the door are arranged in the module in a cutout provided specifically for the purpose. The cutout is bordered by a frame. The frame may be constructed from channels which preferably have a flat surface in the direction of the cutout. The windows and/or doors may be installed centrally or on site.

According to the independent method claim, a module is provided which achieves the above-stated object.

The provision of a module is performed centrally at a factory. For this purpose, a channel is advantageously formed in an intermediate space between at least wall outer sides for example of two outer walls, or in an intermediate space generated by one wall. The intermediate space outside the channel is subsequently filled with a filler material.

An installation level may be attached to the second wall outer side of the module before the filler material is filled in. The installation level may also be attached before a channel is formed, such that the channel and/or the filler material are arranged retroactively.

Empty channels for the installation lines must be formed in the installation level. This is performed for example by drilling along a homogeneous layer of the installation level and/or by arranging empty conduits in the installation level and/or also by milling or slotting from the outside. In order that the empty channels are accessible from the outside, leadthroughs are formed transversely, preferably perpendicularly, with respect to the empty channels, such that a fitting opening for electrical, gas, water, heating, ventilation, communication and/or compressed-air installations to the outside are generated. Preferably, the modules are populated with installation elements at the fitting openings. In particular, the fitting of windows and doors and also of insulation is also possible.

Advantageous refinements of the method for erecting a building are characterized in the following claims.

After the module has been manufactured, it is advantageous for a reinforcement to be arranged in the channels in order to increase the stiffness. The reinforcement may be fitted in either centrally at the factory or locally on the building site.

In order to create a building wall, the module is erected preferably perpendicularly with respect to the floor. The channel is subsequently filled with liquid self-curing material, such as concrete and/or synthetic resin. Multiple modules may be erected adjacent to one another.

In order to produce a building according to the invention, a storey slab must be provided, onto which the module is placed. A lower storey slab of a building is firstly produced. The module or a multiplicity of modules is erected on said storey slab.

Following this, an upper storey slab is produced on the building wall. The storey slabs are constructed from concrete, which is for example present on site. It may be the same concrete that is used for the filling of the channels. Use may also be made of wood.

Lines for the installation are laid on the lower storey slab. A floor heating arrangement may also be arranged on the storey slab. The floor is subsequently constructed for example by means of a floor screed and a floor lining. Likewise, the upper storey slab is used for the laying of lines under the storey slab. A ceiling is subsequently suspended in order to conceal the lines. The lines of the upper and lower storey slabs are led into the empty channels of the installation level of the module. There, they are connected either to one another or to installation elements. The surface of the upper and lower storey slabs thus constitute main installation levels for the building installations. For the electrical and communication installation, the upper storey slab is the main installation level, from which the lines are led to distributor nodes. The water and wastewater has its main installation level in the lower storey slab. Conduit pieces of the water and wastewater installation may be adhesively bonded into the module centrally at the factory already during the fabrication process. They may serve as connections.

It is self-evident that the features mentioned above and the features yet to be discussed below may be used not only in the respectively specified combination but also in other combinations. The scope of the invention is defined only by the claims.

The invention will be discussed in more detail below on the basis of an exemplary embodiment and with reference to the associated drawings.

DETAILED DESCRIPTION OF THE INVENTION

Figure 1A:
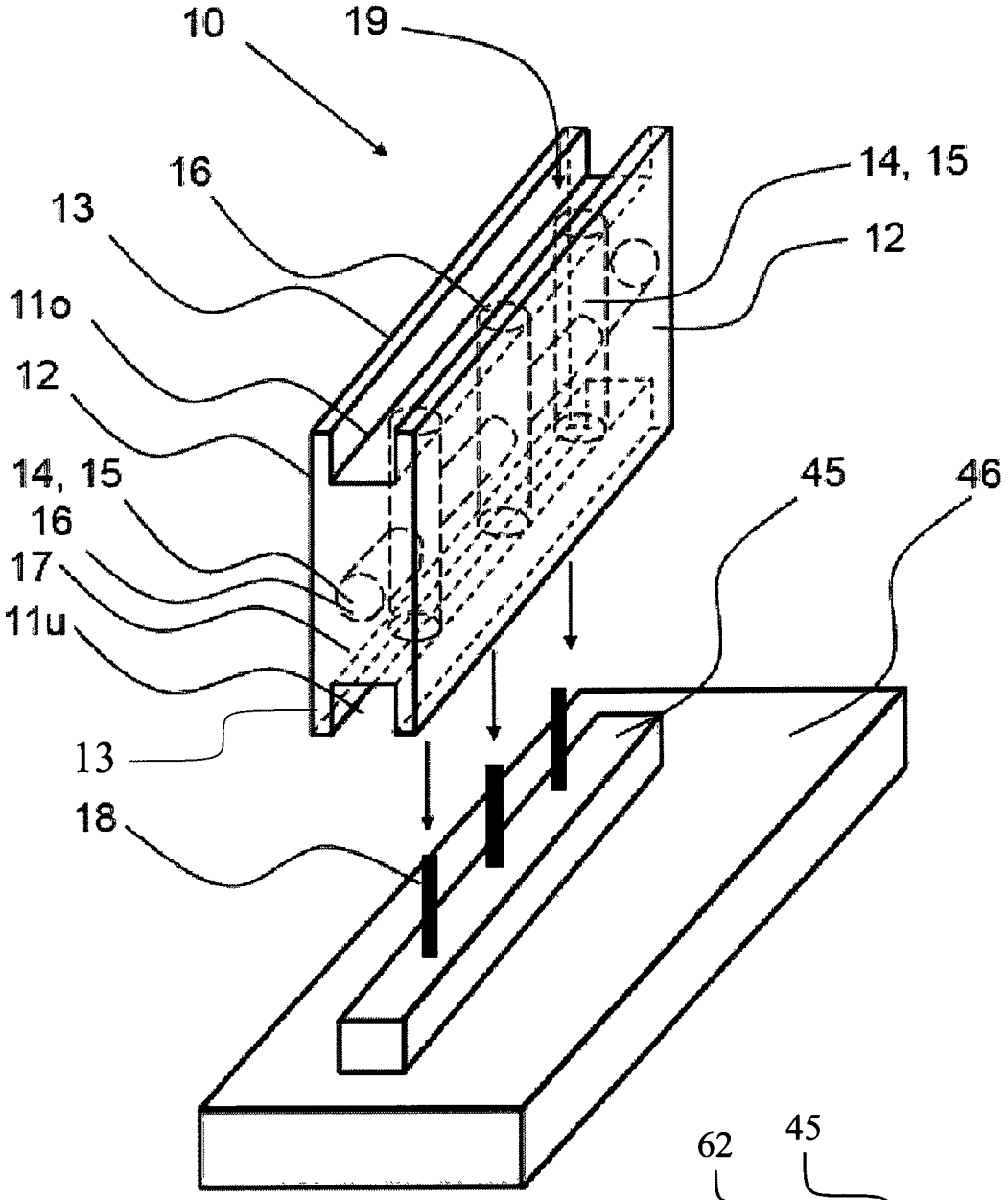
FIG. 1: a) shows a perspective view of a module according to the invention which, in the lower part, is mounted with a groove onto a tongue and, at the upper end, has a channel for forming a continuous supporting beam level, b) shows a variant of the tongue.

FIG. 1*a* shows a module 10 according to the invention which is in the process of being placed onto a lower storey slab 46. For this purpose, a tongue 45 of cuboidal shape has been arranged on the storey slab 46. Three reinforcement rods 18, which are schematically illustrated in FIG. 1, project out of the tongue 45, which reinforcement rods serve in this case by way of example, in addition to a multiplicity of further possibilities, for reinforcement and for the connection of the module 10 to the storey slab 46. The reinforcement rods 18 are formed perpendicularly with respect to the storey slab 46. Likewise, the tongue 45 lies perpendicularly on the storey slab 46. The upper surface of the tongue 45 is parallel to the surface of the storey slab 46.

The module 10 as per FIG. 1*a* comprises a wall 12 with wall outer sides which are arranged parallel to one another and which may be formed by outer walls. A groove 11*u* is formed between the wall outer sides of the wall 12 in the region of the lower end, which groove is delimited along the wall 12 by webs 13. In this exemplary embodiment, at the upper end of the wall module 10, there is situated a formwork channel 11*o* which is open upwardly and to the sides. This, too, is delimited along the wall 12 by webs 13. At the sides, the module boundary 17 is predefined by the length of the wall 12. The groove 11*u* and the formwork channel 11*o* are open at their axial ends in the region of the module boundary 17. In this way, the module 10 is, to the side of the module boundary 17, of H-shaped form, or the cross section through the module 10 is H-shaped.

In the wall 12, there are arranged channels 14 which are formed as circular conduits 15. The conduits 15 are produced for example from hollow firebricks and/or concrete conduits and/or plastics conduits and/or metal conduits. Three vertical conduits 15 are arranged with equal spacing to one another. The spacing corresponds to the spacing of the reinforcement rods 18 to one another. Running horizontally is a conduit 15 which connects the three vertical conduits 15 to one another. It is possible for more or fewer than three vertical and one horizontal conduit 15 to be arranged. The vertical and horizontal conduits may have different cross sections. The conduits may run diagonally. Furthermore, by means of conduits with a relatively smaller diameter, a grid-like supporting structure may be formed which connects or jointly fills the post-and-beam structure. The vertical conduits 15 extend from the upper formwork channel 11*o* to the lower groove 11*u*. Here, the conduit 15 does not project into the upper and the lower groove 11*u* or the formwork channel 11*o*. Alternatively, the conduit 15 may project into the upper and the lower groove 11*u*, 11*o*. The vertical conduits 15 form openings 16 within the lower groove 11*u* and the upper formwork channel 11*o*, which openings are upwardly and downwardly open. Also, in each case one opening 16 is arranged at the module boundaries 17, which opening is generated by the horizontal conduit 15.

The module 10 is mounted with the lower groove 11*u* onto the tongue 45, as symbolized by the three arrows at the lower end of the module 10. In this way, the reinforcement rods 18 are guided into the conduits 15. The tongue 45 has either the dimensions of the groove 11*u*, such that the latter is filled by the tongue 45, or said tongue is alternatively formed with a relatively small height, such that said groove is partially also filled with liquid self-curing material during the building process.

After one or more modules 10 have been arranged on the storey slab 46 on the tongue 45, a liquid self-curing material 19 is filled in through the outwardly directed openings 16. The material 19 may be filled in through only one upper opening 16 or through multiple upper and/or lateral openings 16. The material 19 is preferably liquid concrete.

Figure 1B:
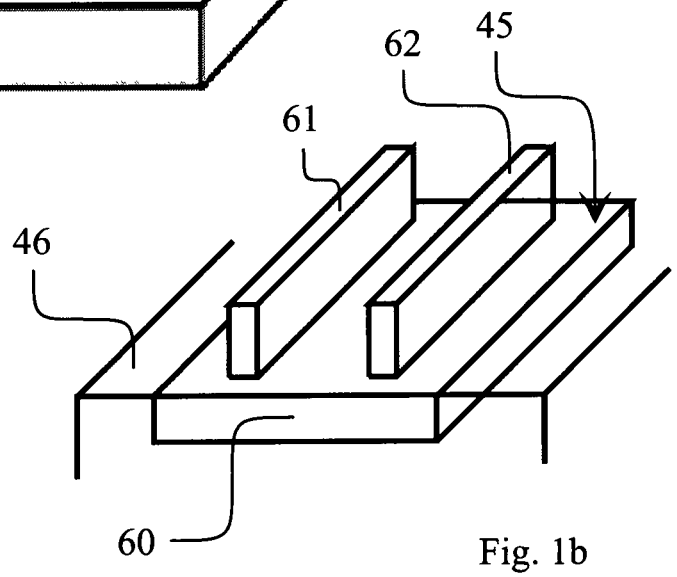

An alternative connection of the module 10 to the storey slab 46 is shown in FIG. 1*b*. There, the tongue 45 is formed by a base panel 60 with two parallel webs 61, 62, which may also be closed at the end sides. During the creation of the storey slab 46, the base panel 60 is jointly integrally cast, and possibly also equipped with spacers or the like, such that preferably the top sides of the storey slab 46 and the base panel 60 lie in one plane. The base panel 60 and the webs 61, 62 may furthermore be equipped with reinforcements, as may the storey slab 46. After the module 10 has been mounted with the groove 11*u* onto the webs 61, 62 and after the reinforcement rods 18 have optionally been inserted, then a liquid self-curing material 19 is cast in through the conduits 15.

It may also be provided that, with the lower groove 11*u* being omitted, the module 10 is held between the webs 61, 62, with the disadvantage that the webs 61, 62 then protrude from the outer walls of the module 10.

It is possible for multiple modules 10 to be erected adjacent to one another, such that the lateral openings 16 thereof are aligned with one another. In this way, the liquid material 19 can flow from one module into another.

Figure 2:
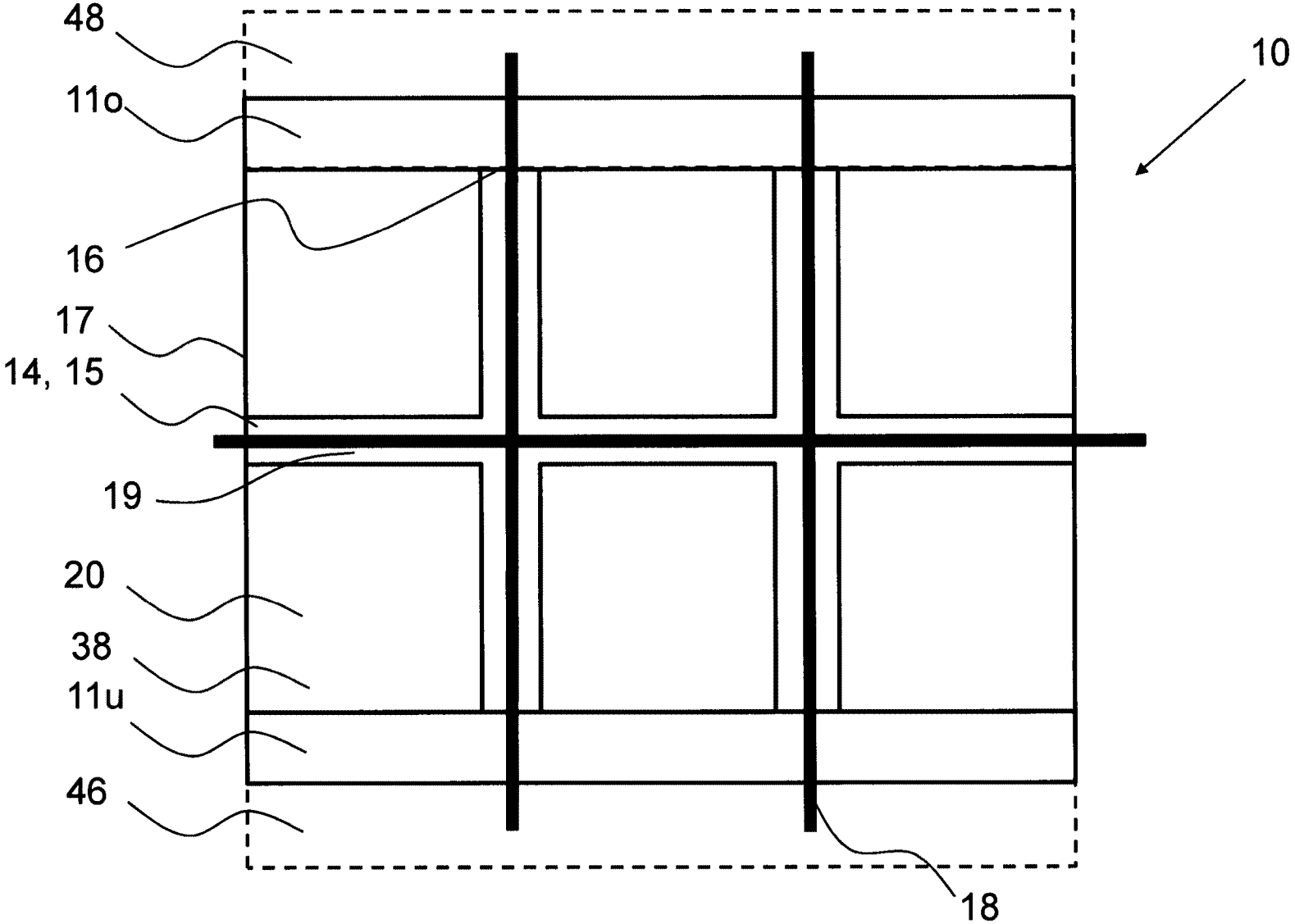
FIG. 2: shows a section through the module according to the invention, wherein reinforcement rods are arranged in channels of the module.

FIG. 2 shows a vertical section through a module 10 according to the invention with only two vertical channels 14, which may be designed as conduits 15.

In the conduits 15, there are arranged reinforcement rods 18, which intersect in accordance with the course of the conduits 15. The reinforcement rods 18 need not imperatively be installed into the channels 14. It is also conceivable for only vertical or horizontal reinforcement rods 18 to be used. It is furthermore possible for reinforcement rods 18 to be arranged in the conduits 15 and to then be connected to the reinforcement rods 18 which project out of the tongue 45. The reinforcement rods 18 which project out of the tongue 45 may preferably be of such a length that they extend through the entire module 10 as far as into the formwork channel 11*o* and beyond, and can thus connect a lower storey slab 46 to an upper storey slab 48. In particular in such a case, the formwork channel 11*o* can be omitted.

In FIG. 2, the horizontal reinforcement 18 projects out at the module boundaries 17, such that the reinforcement 18 projects into a channel 14 of an adjacent module 10, and is fixed there by being concreted in.

On the module 10, there is formed an upper storey slab 48, which is formed by retroactive placement of concrete. The upper storey slab 48 and the upper formwork channel 11*o* may be connected to one another materially and/or by means of reinforcement fabrics and in particular by means of the reinforcement rods 18.

Between the outer sides of the wall modules, there is formed an intermediate space 38, in which the channels 14 or the conduits 15 are also arranged. The intermediate space 38 forms, by means of the conduits 15, compartments which are rectangular. The intermediate space 38 is filled with a filler material 20, such that the channels 14 are at least partially surrounded by the filler material 20. The filler material 20 may comprise polyurethane foam and/or lightweight concrete and/or straw concrete and/or mineral foam and/or expanded stone and/or porous concrete and/or limestone and/or sand-lime brick and/or clay/firestone and/or wood and/or wood derivatives and/or wood fibers and/or other organic fibrous material and/or other inorganic or mineral fibrous material and/or cob and/or loam and/or sand and/or bulk material and/or polystyrene and/or glass wool and/or rock wool and/or recycled material and/or paper and/or asbestos.

Figure 3:
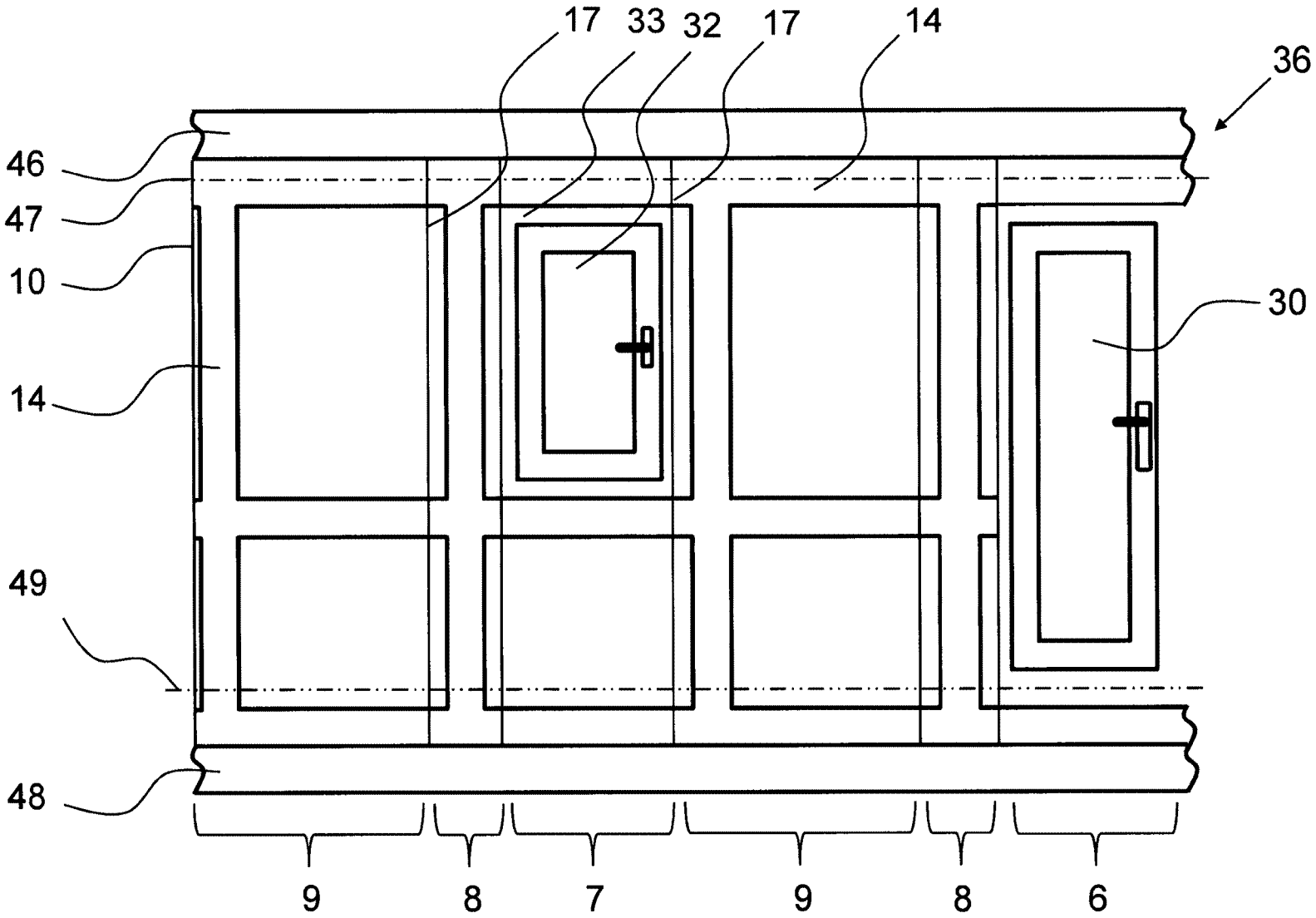
FIG. 3: shows a building wall according to the invention composed of a multiplicity of different modules.

A building wall 36 as per FIG. 3 for a building 34 is constructed from the modules 10. The building wall 36 comprises different module types 6, 7, 8, 9, which are manufactured at a factory and transported to a building site in order to be arranged adjacent to one another there.

A normal module 9 is shown, which has a wall 12 over its entire extent. Furthermore, adjacent to this, a relatively narrow intermediate module 8 is shown. In the intermediate module 8 and the normal module 9, there are arranged in each case one vertical and three horizontal channels 14, which are connected to one another. At the opposite side of the intermediate module 8, there is arranged a window module 7. The window module 7 has a window 32 which is arranged in a cutout 33 formed in the wall 12. The window module 7 has only three horizontal channels 14. It is also possible for a door module 6 to join an intermediate element 8, wherein the door 30 is likewise arranged in a cutout. The door module 6 has two separate channels 14. The module boundaries 17 of the modules 6, 7, 8, 9 bear directly against one another. The building wall 36 is provided by means of the juxtaposition of the modules 6, 7, 8, 9. After the reinforcement rods 18 have been inserted, a liquid self-curing material such as concrete 19 may be cast into the channels 14. The modules 6, 7, 8, 9 may be supplemented by conventional masonry wall work with separate masonry wall bricks.

On the lower storey slab 48, a dashed line is used to indicate the floor structure, which constitutes a main installation level 49 for water and wastewater installations. Likewise, on the upper storey slab 46, a suspended ceiling is indicated by a dashed line, wherein the main installation level 47 for electrical and communication installations is arranged between the storey slab 46 and the suspended ceiling.

Figure 4:
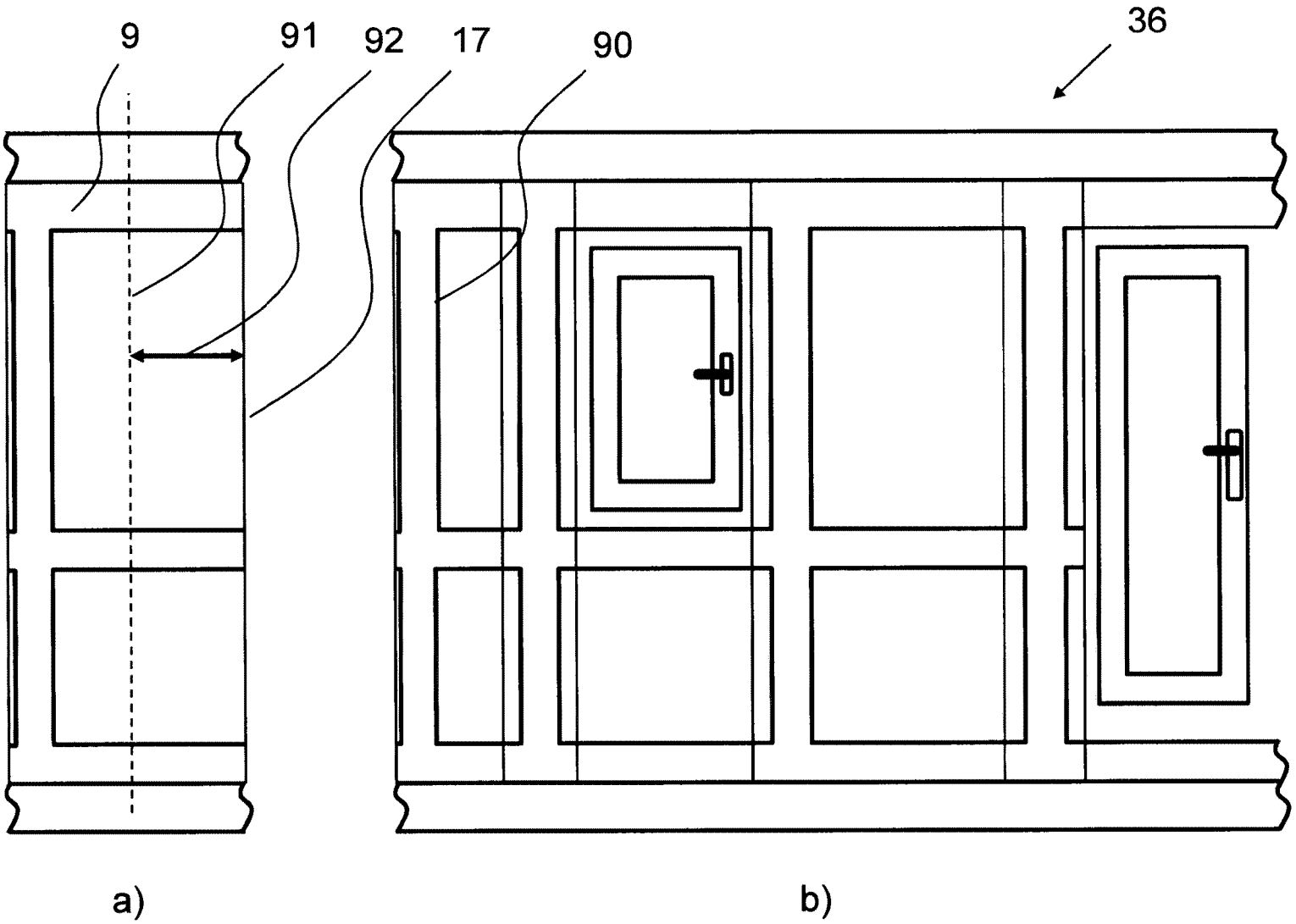
FIG. 4: a) shows a schematic truncation of a module, b) shows a building wall with a truncated module.

The wall elements may be truncated. FIG. 4 illustrates how a normal element 9 is truncated. The truncation may be performed from both sides. Measurement 92 is performed from the right-hand module boundary 17, and a cut 91 is made. This may be performed locally on the building site or centrally at the factory. The truncated module 90 is erected and installed in accordance with the method according to the invention adjacent to a further element, such as for example a window module 7. The building wall 36 can thus be individually truncated.

Figure 5:
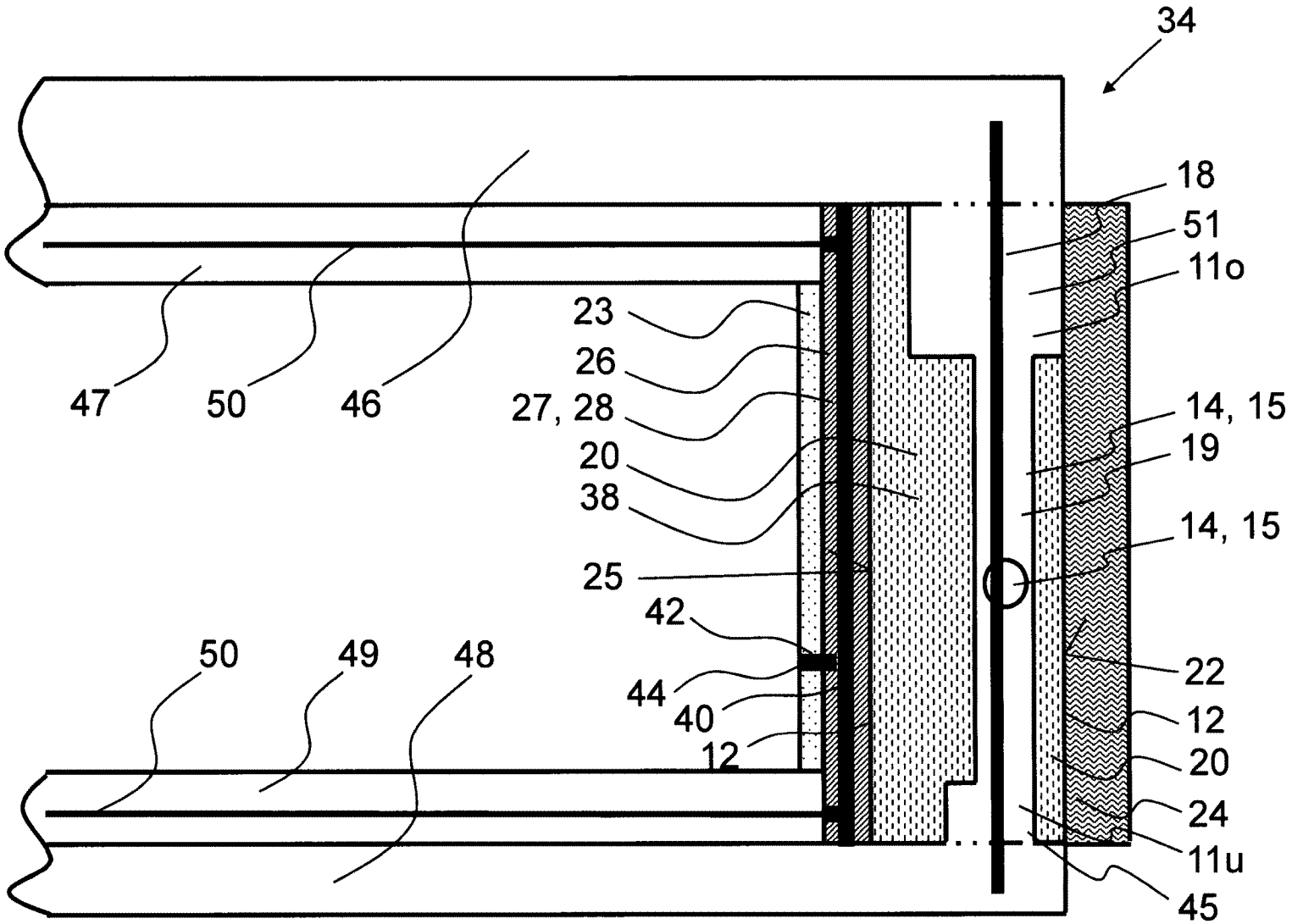
FIG. 5: shows a section through a building according to the invention with a building wall, wherein the modules have been equipped with lines of the building, and with a suspended ceiling and with a floor structure as main installation levels.

FIG. 5 shows a section through the building 34 with the building wall 36. The module 10 is equipped, on a first wall outer side 22 which is formed by the wall 12 and which is directed into the free surroundings, with an insulation layer 24 which comprises polyurethane foam and/or lightweight concrete and/or straw concrete and/or mineral foam and/or expanded stone and/or porous concrete and/or wood and/or wood derivatives and/or wood fibers and/or pressboard panels and/or other organic fibrous material and/or other inorganic or mineral fibrous material and/or cob and/or loam and/or sand and/or bulk material and/or polystyrene and/or glass wool and/or rock wool and/or recycled material and/or paper and/or asbestos and/or wool and/or at least one vacuum chamber.

The oppositely situated wall outer side 25 of the wall 12 is directed into the interior of the building 34. On the second wall outer side 25, there is formed an installation level 26 for electrical and/or hydraulic and/or pneumatic and/or data and/or heating and/or ventilation lines. The installation level 26 is produced by means of wooden slats and/or multipurpose panels which are attached to the wall 12. A plaster 23, which may comprise mineral or organic material, is applied to the installation level 26.

Alternatively, the installation level 26 may be composed of a homogeneous layer 27. It is also possible for a lining wall 28 to be fastened to a slatted construction which generates a cavity between the second wall outer side 25 and the lining wall 28, such that the lines 50 are arranged in the cavity.

Empty channels 40 for the lines 50 are generated in the installation level 26 by means of a vertical drilling process. Such empty channels 40 may be formed or predrilled already during the production process. If the creation is necessary on site, it has proven to be expedient for a perforation in the form of cavities or recesses, which simplify the drilling process, to be formed into the installation level 26 in advance.

The empty channels 40 are made accessible through the plaster 23 and a part of the installation level 26 by means of leadthroughs 42. The leadthroughs 42 have mounting openings 44 on the interior side of the building 34. Installation elements such as water faucets, radiators, plug sockets, switches, microphones and/or loudspeakers can be mounted here. The leadthroughs 42 may also be led to the exterior, for example for the purposes of attaching lights or doorbells to the building wall. Leadthroughs are also formed at the height of the main installation levels 47, 49 at the ceiling and at the floor, such that the lines 50 can be led through the leadthroughs into the empty conduits 40.

The intermediate space 38 has been filled with filler material 20. The channel 14, which is formed as a conduit 15, has preferably been filled with concrete, which is also used for concreting the storey slabs 46, 48. Here, the storey slabs 46, 48 are connected by means of tongue 11*u* and the upper formwork channel 11*o* respectively to the module 10. Furthermore, the reinforcement rods 18 extend from the upper storey slab 46 to the lower storey slab 48. The boundary between storey slab and channel 11*o* is indicated by a dashed line. The formwork channel 11*o* may be larger than the groove 11*u*.

Figure 6:
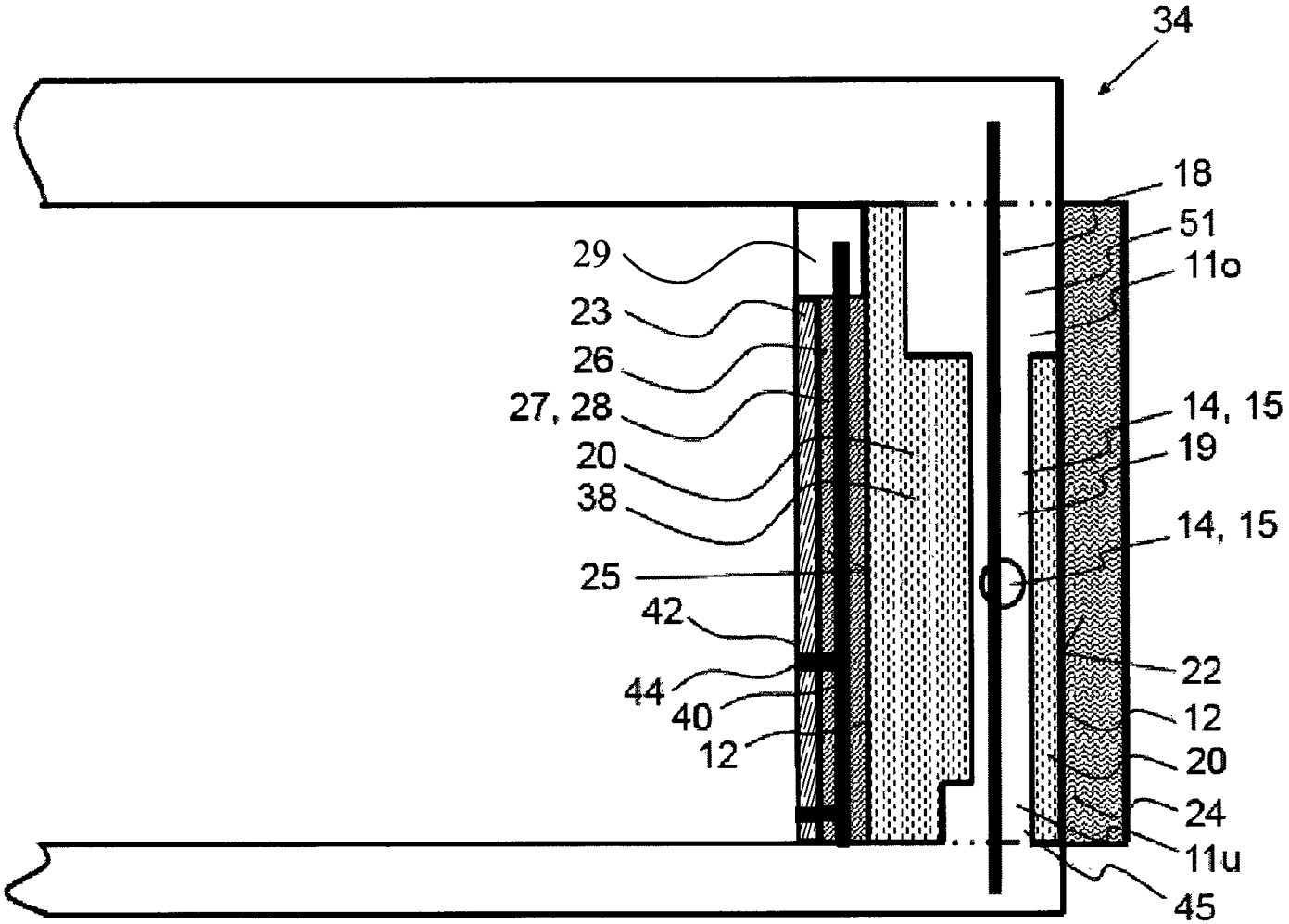
FIG. 6: shows an alternative with an empty channel.

If the formation of the main installation levels 47, 49 by way of a suspended ceiling and the floor structure respectively is not possible or not desired, a preferably horizontally running empty channel 29 is provided, cf. FIG. 6, possibly also as a supplement or alternative to these main installation levels 47, 49. Such an empty channel 29 for accommodating and distributing installations of all types will be positioned in particular in the direction of the storey slabs 46, 48, in the exemplary embodiment in the direction of the upper storey slab 46. It is also possible for multiple such empty channels to be provided, which in particular adjoin the filler material 20. Toward the interior of the building 34, an empty channel 29 of said type extends through the installation level 26 and the plaster 23. After installation has been completed, or upon the completion of the building 34, the empty channel 29 is closed by means of panels composed of wood, glued wood, fibrous fabric, concrete, gypsum, plastics or metal, and possibly plastered. The panels themselves may also already be provided with a filigree surface which terminates flush with the building interior wall surface of the installation level 26.

Figure 7:
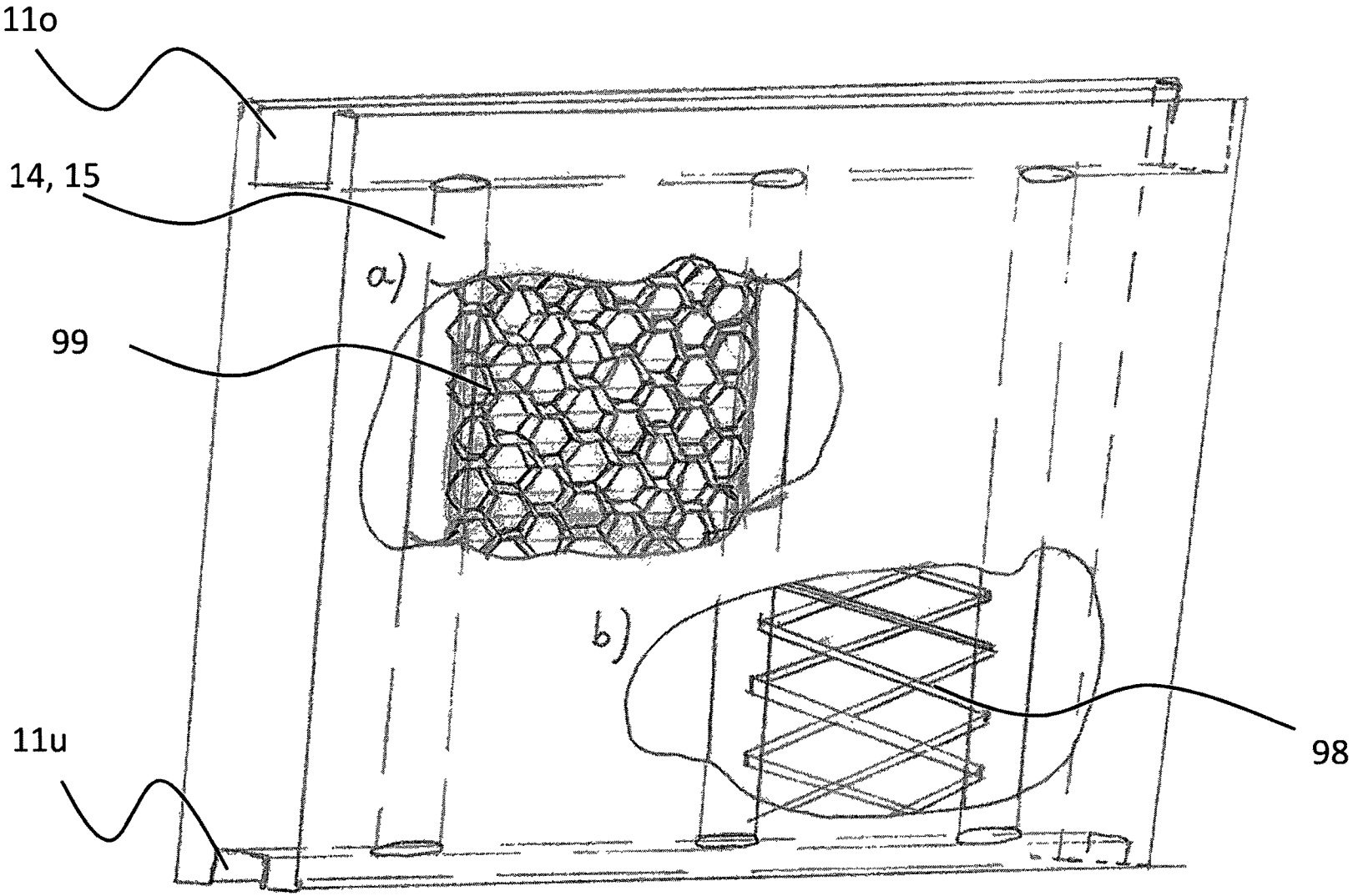
FIG. 7: shows a perspective view of the wall module, wherein two partial sections into the interior of the wall module show the filling of the compartments formed by the posts with a) a honeycomb structure and b) a mesh structure.

FIG. 7 shows the compartments formed by the conduits 15 and channels 14. In FIG. 7*a*), a honeycomb structure 99 is arranged in the intermediate space 38, wherein the honeycomb structure 99 extends areally within the intermediate space 38 along the wall outer side. In FIG. 7*b*), a mesh structure 98 is provided instead. The honeycomb or mesh structure 98, 99 is in this case connected cohesively, or by fastening means such as screws, nails or rivets or hooks, to the conduits 15 and channels 14 and to the upper formwork channel 11*o* and to the lower groove 11*u*. Here, the honeycomb or mesh structure 99, 98 is at least partially surrounded by and thus at least partially filled with the filler material 20.

The honeycomb or mesh structure 98, 99 may be composed of wood and/or wood derivatives and/or pressboard and/or fibrous material and/or plastics and/or synthetic resin and/or concrete and/or porous or straw concrete and/or mineral foam and/or limestone and/or sand-lime brick and/or clay/firestone and/or loam and/or a curing foam such as polystyrene or polyurethane and/or a gypsum-like material.

Furthermore, the honeycomb or mesh structure 98, 99 are, at certain points, led through the filler material to the wall outer sides of the module 10. The mounting points thus generated serve for the fastening of installations and/or installation levels and/or lining walls and/or exterior wall claddings and/or other wall claddings. The mounting points may be composed of the same material as or else of some other material than the honeycomb or mesh structure. It is also possible for dowels or mounting anchors to be provided in the structure.

The invention claimed is:

1. A module or building module partially prefabricated in a factory for installation at a building site, the module comprising:

a lower story ceiling and an upper story ceiling;

a wall of the prefabricated module having a top side, a bottom side, a length defining sides of a module boundary, and at least two outer walls with wall outer sides being spaced apart from one another and extending from said lower story ceiling to said upper story ceiling;

a filler material bordered by said at least two wall outer sides;

at least one channel extending vertically in said filler material between said at least two wall outer sides;

a plurality of conduits fixed between said outer walls and bordering said at least one channel;

a self-curing material filling said at least one channel and causing said at least one channel to form at least one post assuming a static wall function;

a honeycomb or mesh structure disposed between said at least two outer walls in the module and extending externally to and between more than one of said plurality of conduits;

said at least two outer walls having webs projecting from said filler material at least at one of said top side or said bottom side and forming at least one of a framework channel at said top side or a groove at said underside.

2. The module according to claim 1, wherein said at least two wall outer sides are mutually parallel.

3. The module according to claim 1, wherein said at least one conduit is constructed of at least one of hollow firebricks or concrete conduits or plastics conduits or metal conduits, and said at least one conduit is circular or polygonal.

4. The module according to claim 1, wherein said self-curing material filling said at least one channel is at least one of concrete or a plastics resin or plastics or a gypsum-containing material.

5. The module according to claim 1, wherein said at least one channel has an opening to the outside, permitting said at least one channel to be filled from outside the module.

6. The module according to claim 1, wherein said at least one channel at least partially has a reinforcement, wherein the reinforcement extends preferably along said at least one channel.

7. The module according to claim 1, wherein said at least one channel is at least two channels disposed at least one of perpendicular or parallel to one another between said wall outer sides.

8. The module according to claim 1, wherein said at least one channel is at least two channels disposed horizontally or diagonally between said wall outer sides and having different cross sections.

9. The module according to claim 1, wherein said filler material surrounds said at least one channel between said wall outer sides, said filler material being at least one of polyurethane foam or lightweight concrete or straw concrete or mineral foam or expanded stone or porous concrete or wood or wood derivatives or wood fibers or other organic fibrous material or other inorganic or mineral fibrous material or cob or loam or sand or bulk material or polystyrene or glass wool or rock wool or recycled material or paper or asbestos.

10. The module according to claim 1, wherein said wall outer sides include a first wall outer side, an insulation layer is attached to said first wall outer side, and said insulation layer includes at least one of polyurethane foam or lightweight concrete or straw concrete or mineral foam or expanded stone or porous concrete or limestone or sand-lime brick or clay/firestone or wood or wood derivatives or wood fibers or pressboard panel or other organic fibrous material or other inorganic or mineral fibrous material or cob or loam or sand or bulk material or polystyrene or glass wool or rock wool or recycled material or paper or asbestos or at least one vacuum chamber.

11. The module according to claim 1, wherein said wall outer sides include a first wall outer side directed toward a building exterior, and an insulation layer and a building external cladding are attached on said first wall outer side, said building external cladding being attached to a supporting structure or anchored in the module, and anchoring elements being fitted in the module.

12. The module according to claim 1, wherein the module forms internal walls along with other modules, and a respective installation level is formed on each of said wall outer sides.

13. The module according to claim 1, which further comprises a lining wall, and at least one of said wall outer sides or said lining wall includes at least one of wood, wooden slats, hardboards, organic, inorganic or mineral fiberboards, gypsum board, concrete, sheet metal, plastic or cardboard.

14. The module according to claim 1, which further comprises at least one of a window or a door disposed in the module.

15. The module according to claim 1, wherein said honeycomb or mesh structure forms installation points on one of said wall outer sides, and said installation points are formed by at least one of dowels or installation anchors.

16. The module according to claim 1, wherein said wall has a cutout with a frame formed by channels.

17. A building, comprising:

a building wall including at least one or a plurality of modules according to claim 1.

18. A method for producing a building wall, the method comprising:

producing at least one module according to claim 1;

erecting the module;

introducing a reinforcement into a channel; and filling the channel with at least one of a liquid self-curing material or concrete or synthetic resin.

19. A method for producing a building, the method comprising:

creating a lower story slab of a building;

erecting a building wall including at least one of the modules according to claim 1 on the lower story slab;

creating an upper story slab on the building wall;

routing lines at least one of on the story slabs or in an empty channel of an installation level formed on one of the wall outer sides; and introducing the lines into the empty channels.

20. A method for producing a module or a building module, the method comprising:

forming a channel between at least first and second wall outer sides of a wall;

filling an intermediate space between the wall outer sides with a filler material;

placing an installation level on the second wall outer side;

forming empty channels in the installation level; and forming leadthroughs transversely relative to the empty channels to produce a fitting opening for at least one of electrical, gas, water, ventilation, communication or compressed-air installations leading to the outside.

21. The method according to claim 20, which further comprises:

forming the empty channels in the installation level by at least one of drilling along the installation level or installing empty conduits;

additionally milling or slotting installation channels;

populating the fitting opening;

inserting windows and doors; and placing an insulation layer on the first wall outer side.

22. A module or building module partially prefabricated in a factory for installation at a building site, the module comprising:

a lower story ceiling and an upper story ceiling;

a wall of the prefabricated module having a top side, a bottom side, a length defining sides of a module boundary, and at least two outer walls with wall outer sides being spaced apart from one another and extending from said lower story ceiling to said upper story ceiling;

a filler material bordered by said at least two wall outer sides;

at least one channel extending vertically in said filler material between said at least two wall outer sides;

at least one conduit fixed between said outer walls and bordering said at least one channel;

a self-curing material filling said at least one channel and causing said at least one channel to form at least one post assuming a static wall function;

a honeycomb or mesh structure disposed between said at least two outer walls in the module;

said at least two outer walls having webs projecting from said filler material at least at one of said top side or said bottom side and forming at least one of a framework channel at said top side or a groove at said underside;

said wall outer sides including a first wall outer side and a second wall outer side, said second wall outer side directed into the building interior;

an installation level formed on said second wall outer side for at least one of electrical or hydraulic or pneumatic or data or communication or ventilation lines, said installation level being at least one of formed by a homogeneous layer or disposed between a lining wall and said wall.

* * * * *